US006966513B2

(12) United States Patent
Chang

(10) Patent No.: US 6,966,513 B2
(45) Date of Patent: Nov. 22, 2005

(54) LINKAGE MECHANISM OF PAPER-CUT AND ANTI-BLOCK OF DOUBLE-DUTY SHREDDER

(76) Inventor: Frank Chang, 3/F., No. 200, Xinyi Road, Section 3, Taipei (TW) 106

( * ) Notice: Subject to any disclaimer, the term of this patent is extended or adjusted under 35 U.S.C. 154(b) by 0 days.

(21) Appl. No.: 10/338,670

(22) Filed: Jan. 9, 2003

(65) Prior Publication Data

US 2004/0135019 A1 Jul. 15, 2004

(51) Int. Cl.[7] ..... B02C 13/20
(52) U.S. Cl. ..... 241/236; 241/101.01; 241/152.1; 241/237
(58) Field of Search ..... 241/101.01, 152.1, 241/236, 237

(56) References Cited

U.S. PATENT DOCUMENTS 3,620,461 A * 11/1971 Pelleschi et al. ..... 241/100
6,079,645 A * 6/2000 Henreckson et al. ..... 241/37.5

* cited by examiner

*Primary Examiner*—Derris H. Banks
*Assistant Examiner*—Jason Y Pahng
(74) *Attorney, Agent, or Firm*—Dennison, Schultz, Dougherty & MacDonald

(57) ABSTRACT

The present invention is a linkage mechanism of cut-paper and anti-block of double-duty shredders, main comprising: stripe-cutter wheel group, latitude cutter, drive shaft, paper-expeller, crank coupler link group and intermittent cluster gear, is that crank coupler link drive latitude-cutter to cut horizontally the paper to be cut, then intermittent cluster gear control the stripe-cutter wheel group to pull down the paper to be cut to act longitudinal cut, and by the circle cross movement, the paper to be cut will be cut into chips.

3 Claims, 4 Drawing Sheets

LINKAGE MECHANISM OF PAPER-CUT AND ANTI-BLOCK OF DOUBLE-DUTY SHREDDER

FILED OF THE INVENTION

The present invention relates to a double-duty shredder that can shift freely between different effects of stripe-cut and cross-cut, especially provides a linkage mechanism that can realize the effect of latitude cut and longitudinal cut and anti-block.

BACKGROUND OF THE INVENTION

Shredders can be classed into two types, the stripe-cut shredders and cross-cut shredders, according to the machine cut style, the former comprises a set of blades used for cutting on revolving cut wheel to cut paper into strips, the latter comprises blades being provided with more than one hook-shaped edges and the edges are disposed helically around the revolving cut wheel to cut paper into strip longitudinally and cut paper into shatter of 5 mm×40 mm in latitudinal direction. Because the cut effect of latter is better than the that of garbage or the effect of keep security of destroying the contents on the paper, the cross-cut shredders has become the main flow of the market. Just because the cross-cut shredders cut paper more tinny, so the motor that provides the drive revolving cut wheel must more powerful than that of stripe-cut shredders. Besides because the blade used for cutting of stripe-cut shredders is provided with more than one hook-shaped edges, to avoid accidentally injure operator on the circumstance of the current is not break, so ISO have a regulation that the shredders must have safe activation switch, namely, cross-cut shredders act only on the condition that be set on the fixed position of garbage container provided with manufacture, on the contrary, if the shredders being removed from the garbage container the current will be broken.

SUMMARY OF THE INVENTION

Whereas those mentioned above, the present invention contemplates combining a cross-cut shredder and stripe-cut shredder into a unit, and a strip cross double-duty. The present invention provides a linkage mechanism to make double-duty shredders realize the effect of latitude cut and longitudinal cut and anti-block of chips.

And, namely, the main object of the present invention is to provide a linkage mechanism of cut paper and anti-block of double-duty shredders to make latitudinal cut blade and longitudinal cut blade of double-duty fulfill the act of cut paper by the cross movement of crank coupler link device and intermittent cluster gear.

The second object of the present invention is to provide a linkage mechanism of cut paper and anti-block of double-duty shredders, to make the paper chips left in the groove of cutter be expel out by expeller to avoid paper block after latitudinal cutter blade cut the paper.

DESCRIPTION OF THE PREFERRED EMBODIMENT

Figure 1:
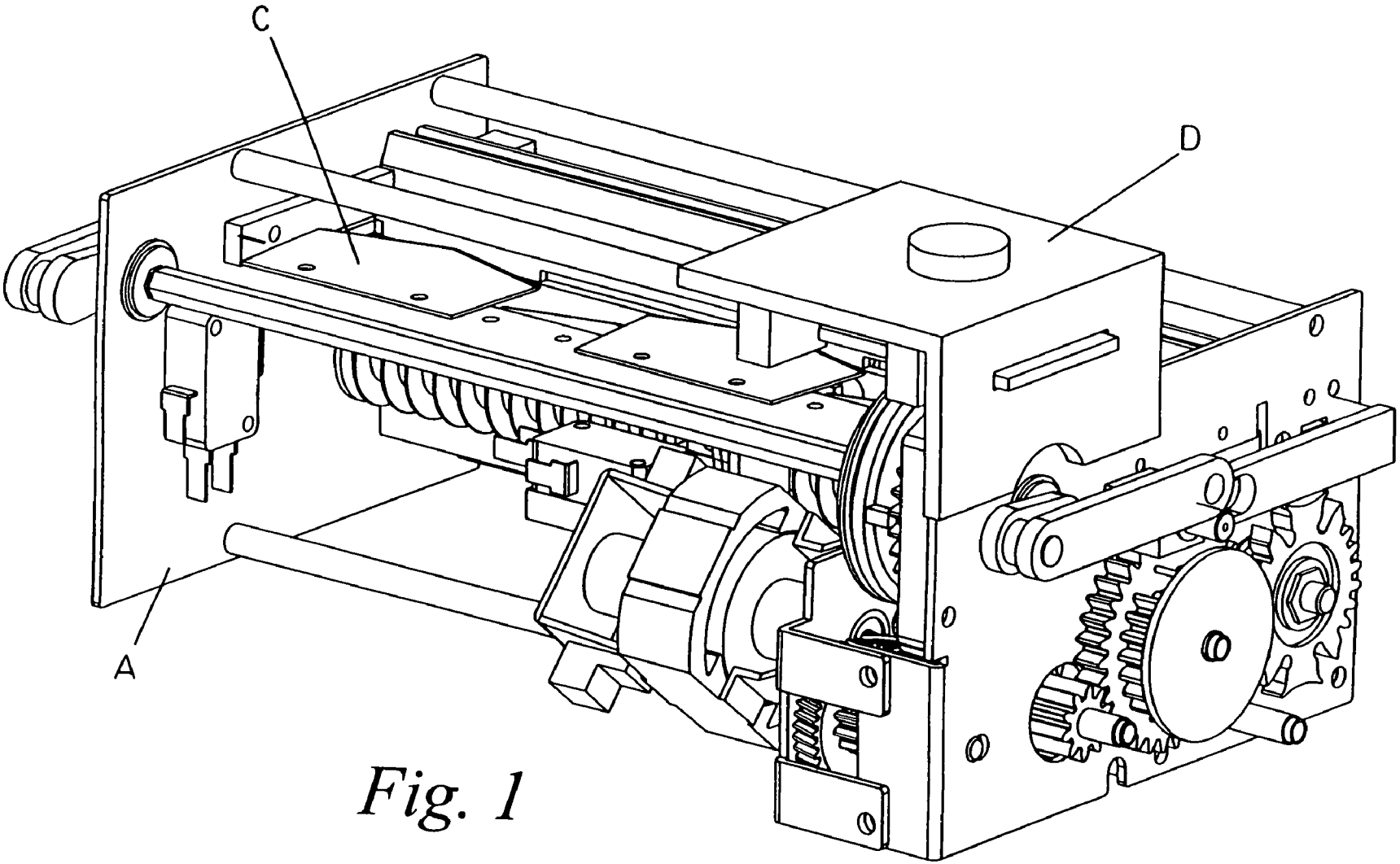
FIG. 1 is a perspective view of outline of double-duty shredder.
Figure 2:
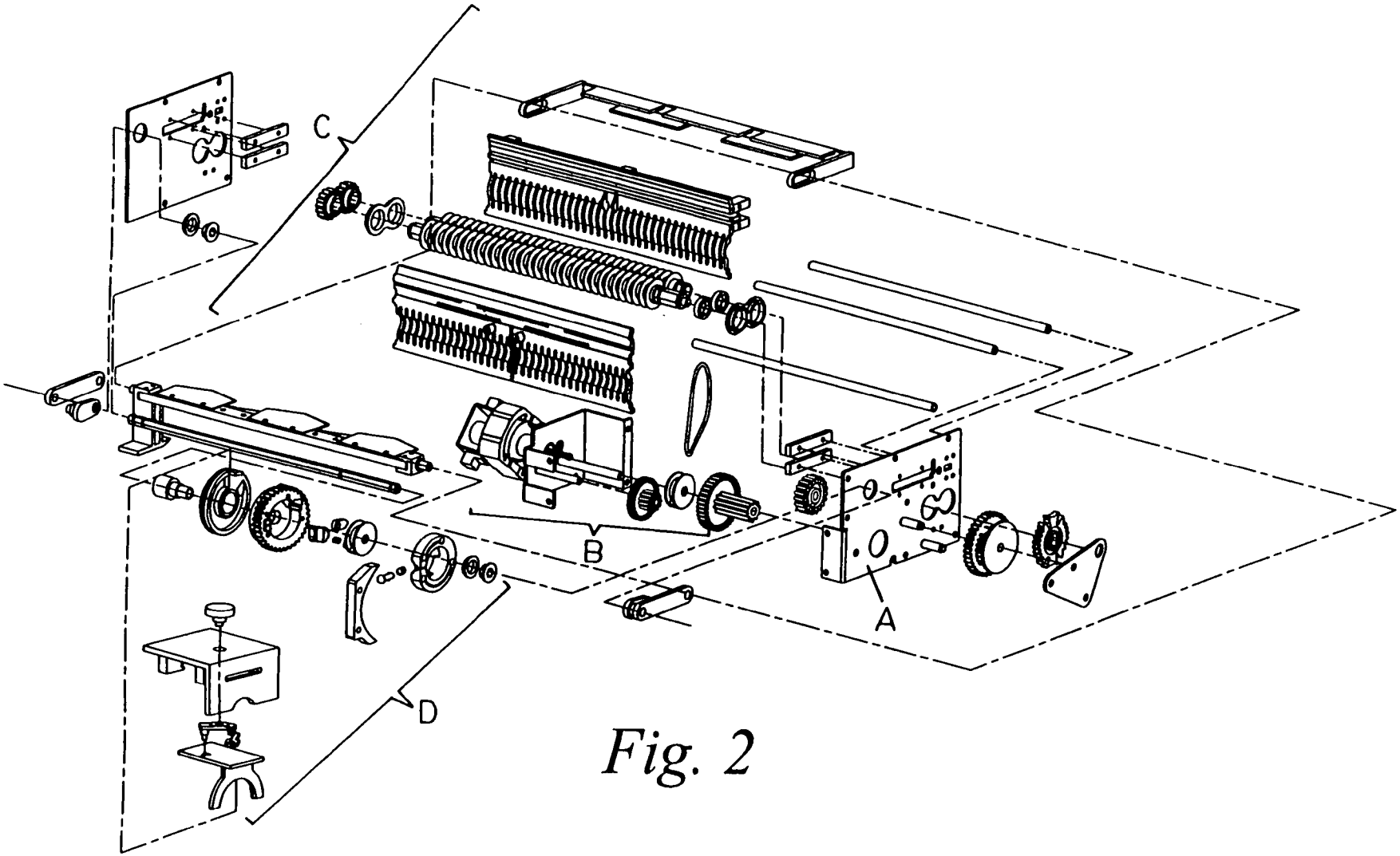
FIG. 2 is a general view of parts of double-duty shredder.

Referring to FIGS. 1 and 2, a double-duty shredder is shown comprising a main body A, a motor drive mechanism B, a linkage mechanism of latitude cut/longitudinal cut and anti-block C, and a strip/cross switch mechanism D.

Figure 3:
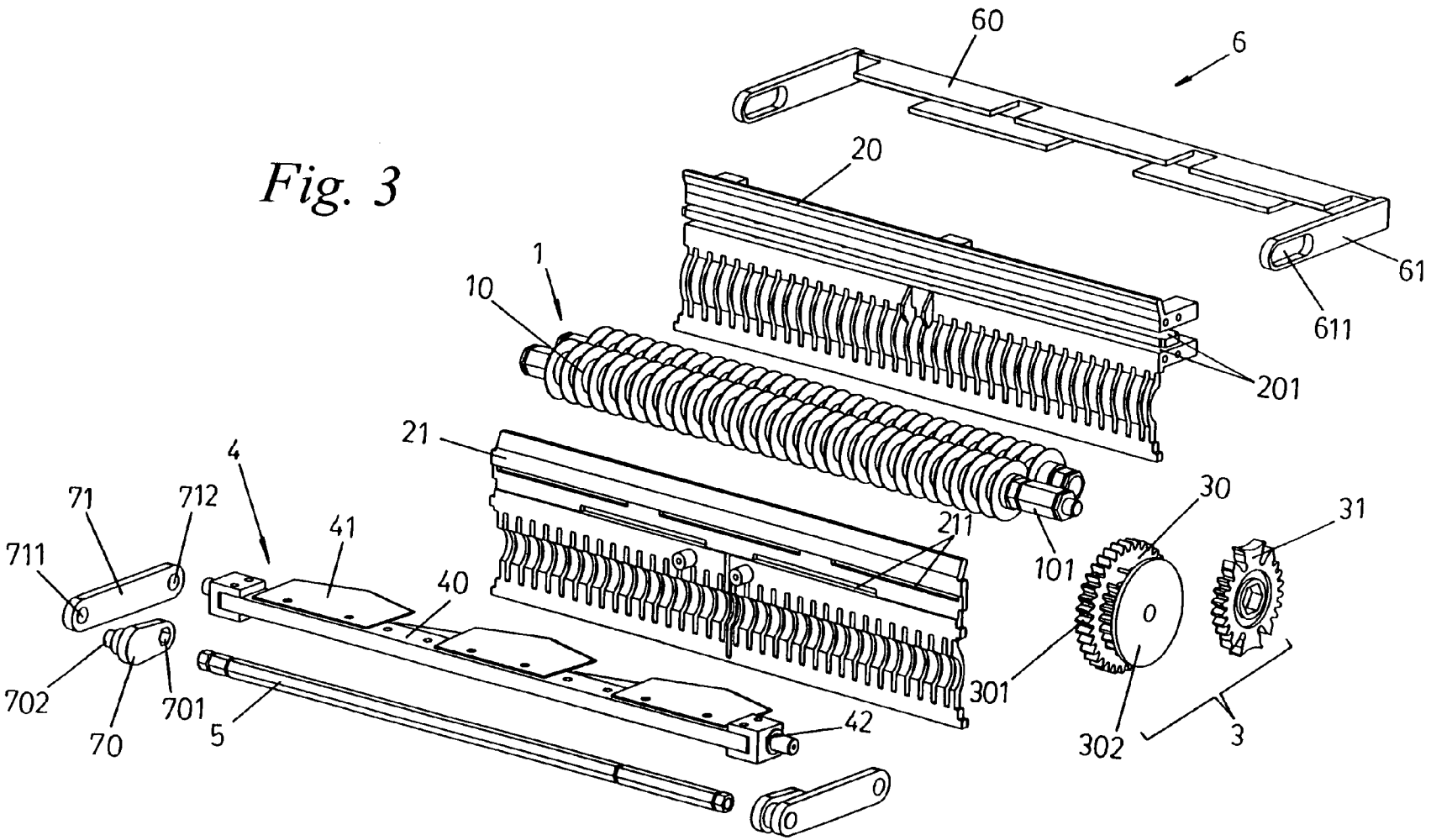
FIG. 3 is an exploded perspective view of the present invention.

Referring to FIG. 3, the present invention comprises a linkage mechanism of paper-cut and anti-block of double-duty shredder, having a strip cutter wheel group 1 for longitudinal cut disposed between front paper-guide plate 20 and rear paper-guide plate 21, wherein the end of axis 101 of drive cutter wheel 10 is fixed to driven gear wheel 31 of intermittent cluster gear 3. A latitudinal paper cutter 4 is disposed on a first side of the rear paper-guide plate 21, and provided with cutter 41 on the top and bottom of quadrate cutter setting 40, and a cutter rest 42 is fixed respectively to the two ends of cutter setting 40. A drive shaft 5 is disposed on a first side of the paper cutter 4 and is rotationally powered by the motor drive mechanism B.

A paper-expeller 6 is disposed on a second side of the paper-guide plate 20, and is inverted U-shaped and, is provided with paper-expel plate 60 and two side support arms 61, wherein, the end of support arm 61 includes a long-holed groove.

A crank coupler link group 7, wherein one end 701 of crank 70 is secured to said drive shaft 5, the other end 702 is secured to fixed end 711 of coupler link 71, the free end 712 of coupler link 71 is set in the long-hole groove 611 of two supporting arms 61 of said paper-expeller 6 after engaged with cutter rest 42 of said latitudinal paper-cutter 4.

A intermittent cluster gear 3, wherein drive gear 30 consists of normal gear wheel 301 and abnormal gear wheel 302, normal gear wheel 301 intermesh with motor drive gear wheel B to receive the rotate power and rotates driven gear wheel 31 intermeshed with normal gear wheel 31 and strip cutter wheel group 1.

Figure 4:
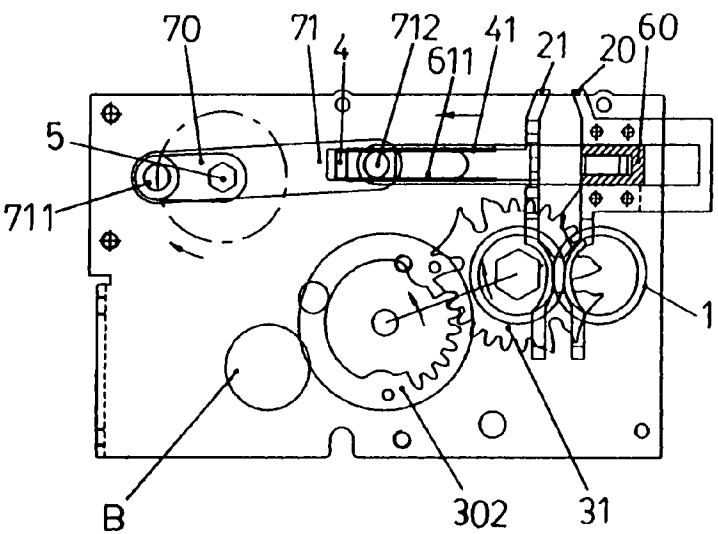
FIG. 4 is a dynamic sectional view of the present invention.
Figure 4:
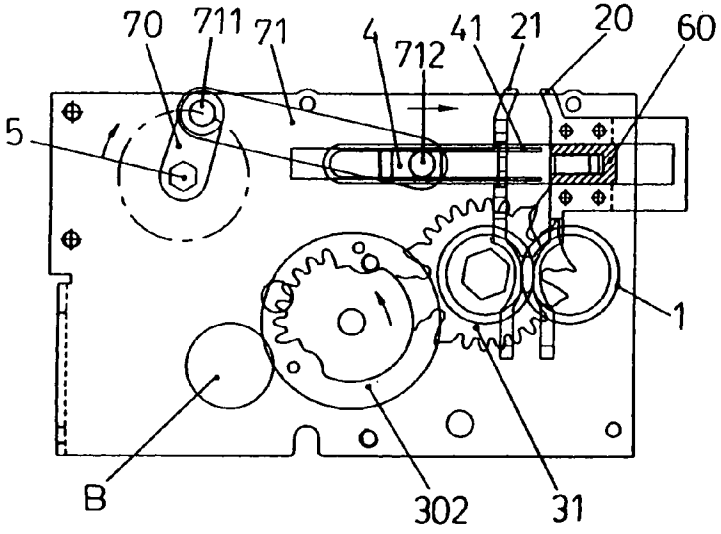
Figure 4:
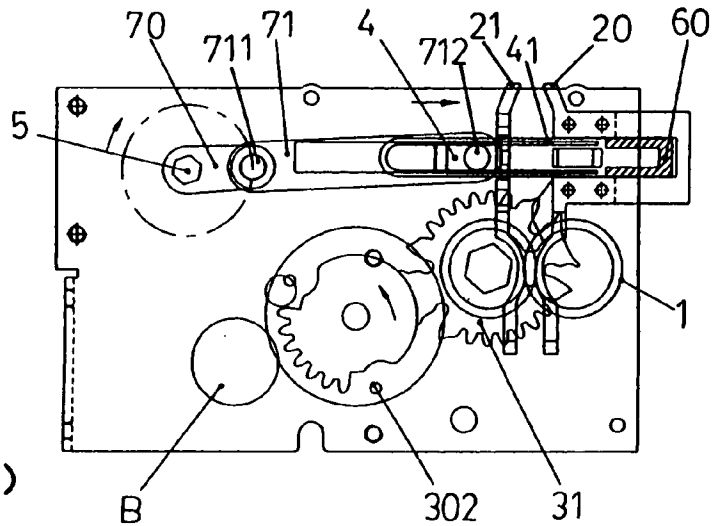

Referring to FIG. 4, the linkage mechanism of paper-cut and anti-block of double-duty shredder, as shown in view A, includes a coupler link 70 rotatable in a clockwise direction with the drive shaft 5, a free end 712 of coupler link 71 and latitude paper-cutter 4 will be driven and move the long-holed groove 611 of the paper-expeller 6, two-layer cutter 41 to paper to be cut through the pre-left cutter groove 211 of rear paper-guide plate 21. The track length of circle movement of coupler link 70 is longer than the length of long-holed groove 611, so that the free end 712 of coupler link 71, as shown in view B, will compel paper-expeller 6 to move right in latitude direction, wherein the space left in the cutter groove 201 of front paper-guide plate 20 is disposed on the paper-expel plate 60 after paper-expel plate is moved to right.

When two-layer cutter 41 finished prink the paper to be cut, as shown in view C, will rotate roundly with coupler link 70 and be pull back to left side by coupler link 71, and in the same way, when track length of circle rotate of coupler link 70 is longer than the length of long-hole groove 611, paper-expeller 6 will be compelled move left to make paper-expel plate 60 will move the paper chips left in the cutter groove 201 of paper-guide plate 20 alone the direction of strip cutter wheel group 1 to garbage container, to avoid paper chip store up cutter groove 201 of paper-guide plate 20 cause block.

The strip cutter wheel group 1 is in a static state when the latitude cutter 4 engages with the paper to be cut, because the strip cutter wheel group 1 will pull the paper to be cut down, and the paper to be cut cannot remain in a static state in the course of latitudinal cut. This function of strip cutter wheel group 1 pulling the paper to be cut down will tear the paper to be cut. So the strip cutter wheel group 1 must be kept in static state in the course of latitudinal cutter 4 engaging with the paper to be cut.

Referring to the views A, B, C of FIG. 4, the drive gear wheel 30 of intermittent cluster gear 3 consists of normal gear wheel 301 and abnormal gear wheel 302, the normal gear wheel 301 intermeshes with motor drive to rotate the driven gear wheel 31 intermeshed with the strip cutter wheel group 1. It can be seen form the drawings, the intermittent gear wheel 3 is a partial gear wheel of special design, wherein, approximately a quarter of the gear wheel 302 has the drive function, the other part does not have teeth and can not transfer power. The driven gear wheel 31 intermeshed with normal gear wheel 301 is provided symmetrically with parts having teeth and parts having no teeth, in other words, only when the parts having teeth of abnormal gear wheel 302 intermeshes with the parts having teeth of driven gear wheel 31 the driven gear wheel 31 will rotate strip cutter wheel group 1, otherwise, the strip cutter wheel group will lose the source of power and keep static. The parts having teeth of abnormal gear wheel 302 do not intermesh with the parts having teeth of driven gear wheel 31, they are in slipping state, so strip cutter wheel group 1 will be in a static state, the period of time that slipping movement needed will be provide to latitude cutter 4 to engage with the paper to be cut.

In view C, the cutter rotates with crank 70 and is pulled back to left by coupler link 71 after finished pricking the paper to be cut; and then, the parts having teeth of abnormal gear wheel 302 intermeshes with the parts having teeth of driven gear wheel 31 and rotate strip cutter gear wheel 1 to pull paper to be cut down and cut longitudinally these paper. So, paper to be cut have been pricked by cutter 41 before be pulled down and be cut longitudinally by strip cutter gear wheel 1, so the effect of cutting paper will realize by the cross movement in circles of cutting the paper to be cut into paper chips.

We can conclude from the above mentioned, the present invention use the strip cutter gear wheel of stripe-cut shredder as longitudinal paper-cutter, the motor can be a smaller type than that of cross-cut shredder and will not confined by the ISO regulation that install compulsory active switch. Actually, the cross-cut shredder realize the effect of cut paper to be cut into chips by the latitude pricking of latitudinal cutter and he longitudinal cutting of said strip cutter wheel. The present is actually a new invention, and comply with the regulation for applying a patent.

What is claimed is:

1. A shredder, comprising:

two opposite strip cutter wheel groups for longitudinal cutting disposed between a front paper-guide plate and a rear paper-guide plate, an axle having a first end, and an intermittent cluster gear, wherein the end of said axle is fixed to a driven gear wheel of said intermittent cluster gear;

a latitudinal paper cutter disposed on a first side of said rear paper-guide plate having set cutter on top and bottom of quadrate cutter setting and a cutter rest fixed respectively to two ends of said cutter setting;

a drive shaft disposed on a first side of said paper cutter and rotatably operable by a motor;

a generally inverted U-shaped paper-expeller disposed on a second side of said rear paper-guide plate having paper-expel plate and two side support arms having a long-holed groove at an end thereof;

a drive shaft and a crank coupler link group having a first end secured to a said drive shaft and a second opposing end secured to fixed end of said crank coupler link and is set in the long-hole groove of two supporting arms of said paper-expeller after engaging with cutter rest of said latitudinal paper-cutter;

said intermittent cluster gear comprising a normal gear wheel intermeshed with motor drive gear wheel rotating the driven gear wheel intermeshed with said normal gear wheel and strip cutter wheel group and abnormal gear wheel.

2. The shredder according to the claim 1, wherein said front paper-guide plate and said rear paper-guide plate are pre-provided with cutter groove that cutter pass through.

3. The shredder according to claim 1, wherein the drive gear wheel and the driven gear wheel of intermittent cluster gear include partial teeth, wherein the driven gear is rotated when the teeth-portion parts intermesh, and the driven gear wheel will keep static state when the two gear wheels are in slipping static state.

* * * * *